US005865006A

United States Patent [19]

Dawson

[11] Patent Number: 5,865,006

[45] Date of Patent: Feb. 2, 1999

[54] RETAINING WALL BLOCK AND WALL CONSTRUCTION

[75] Inventor: William B. Dawson, Maple Grove, Minn.

[73] Assignee: Keystone Retaining Wall Systems, Inc., Bloomington, Minn.

[21] Appl. No.: 867,363

[22] Filed: Jun. 2, 1997

[51] Int. Cl.[6] ..... E04C 2/04

[52] U.S. Cl. ..... 52/604; 51/100; 51/608; 51/610; 51/562; 51/596; 51/585.1; 405/262; 405/284; 405/258; 405/286

[58] Field of Search ..... 52/561, 568, 585.1, 52/59.6, 599, 604, 608, 609, 610, 562, 100; 405/286, 262, 258, 273, 275, 284

[56] References Cited

U.S. PATENT DOCUMENTS

| | | | |
|---|---|---|---|
| Re. 34,314 | 7/1993 | Forsberg . | |
| D. 296,007 | 5/1988 | Forsberg . | |
| 2,323,363 | 11/1943 | Schmitt . | |
| 4,914,876 | 4/1990 | Forsberg | 52/169.4 |
| 5,017,049 | 5/1991 | Sievert | 52/596 X |
| 5,294,216 | 3/1994 | Sievert | 405/286 |
| 5,598,679 | 2/1997 | Orton et al. | 52/604 X |
| 5,711,130 | 1/1998 | Shatley | 52/604 |

*Primary Examiner*—Christopher Kent
*Assistant Examiner*—Yvonne Horton-Richardson
*Attorney, Agent, or Firm*—Popovich & Wiles, P.A.

[57] ABSTRACT

A retaining wall block and wall construction are disclosed. The retaining wall block is characterized in that it includes a removable flange having pin apertures which pass through the flange and into the body of the block. Such blocks allow the construction of walls having flange connections between adjacent courses of blocks or, when the flange is removed, pin connections between adjacent courses of blocks. The latter connection system is particularly well-suited for constructing walls that require soil reinforcement systems such as geogrids.

25 Claims, 13 Drawing Sheets

*Fig. 19c*
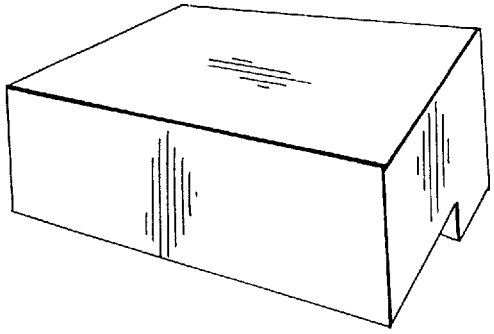
*Fig. 19d*
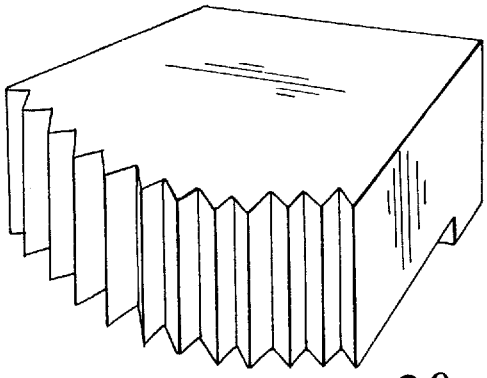
*Fig. 20c*
*Fig. 20a*
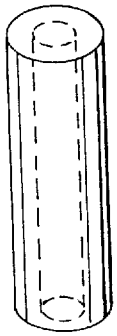
*Fig. 20b*
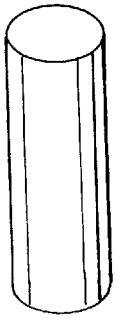
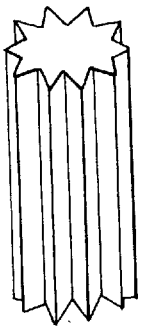
*Fig. 20d*
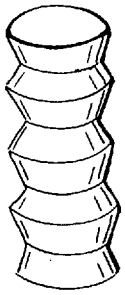

RETAINING WALL BLOCK AND WALL CONSTRUCTION

FIELD OF THE INVENTION

The present invention is in the field of retaining walls and blocks used to construct retaining walls where a soil reinforcement matrix or geogrid is used to reinforce the wall structure to withstand earth pressures.

BACKGROUND OF THE INVENTION

Numerous methods and materials exist for the construction of retaining walls. Such methods include the use of natural stone, poured in place concrete, masonry, and landscape timbers or railroad ties. In recent years, segmental concrete retaining wall units which are dry stacked (i.e., built without the use of mortar) have become a widely accepted product for the construction of retaining walls. Examples of such units are described in U.S. Pat. No. RE 34,314 (Forsberg) and in U.S. Pat. No. 5,294,216 (Sievert).

Segmental concrete retaining wall units have gained popularity because they can be mass produced, and thus, are relatively inexpensive. In addition, they are structurally sound, easy and relatively inexpensive to install, and combine the durability of concrete with the attractiveness of various architectural finishes.

The retaining wall system described in U.S. Pat. No. RE 34,314 includes a block design that incorporates, among other elements, a system of pins that interlocks and aligns the retaining wall units, allowing structural strength and relatively quick installation. The system may be adapted for the construction of large walls by employing geogrids which can be hooked over the pins. Such a system is described in U.S. Pat. No. 4,914,876 (Forsberg).

Numerous block designs have used a shear connector embodied in the block's shape to align the blocks with a setback, or batter. A common form of such shear connectors is a rear, downwardly projecting lip or flange. In forming a multi-course wall, the blocks are placed such that the flanges contact the upper back edge of the blocks located in the course below. As such, blocks having flanges are caused to become aligned with the blocks positioned below, while at the same time providing a degree of resistance against displacement of individual blocks by earth pressures. In walls formed using blocks of this type, the rear flanges of the blocks cause the wall to slope backward at an angle which is predetermined by the width of the flanges.

Retaining walls using blocks having a rear flange are well known in the art. For example, U.S. Pat. No. 2,323,363 (Schmitt) describes an early use of a retaining wall block with a rear flange. More recently, U.S. Pat. No. 5,294,216 (Sievert) describes a geogrid reinforced retaining wall constructed with retaining wall blocks having rear flanges. Such blocks function adequately for small walls where soil reinforcement is not necessary because they are relatively simple to install and require no special pieces for capping the top course of the wall.

Modular retaining walls are designed to function either as gravity walls or reinforced earth structures. A gravity wall relies only on the mass of the retaining wall units to resist the earth pressures that act on the wall to cause it to bulge, slide out, or overturn. Modular retaining wall blocks are suitable for construction of gravity walls up to certain heights, typically in the range of about three to six feet, depending on the particular block design employed.

For taller walls or walls subjected to additional loads due to other factors, reinforced soil methods are available to construct the wall. Such methods include the use of (1) geogrids (synthetic mats or matrices that are connected to the retaining wall units and laid out horizontally into the backfill area as the wall is built), (2) synthetic fabrics that are used in a similar fashion to geogrids, and (3) steel matrices, strips, or mats. Using soil reinforcement techniques, walls having heights in excess 50 feet can be built.

The use of soil reinforcing matrices or geogrids with modular retaining wall products is well known in the art. Previously referenced U.S. Pat. No. 4,914,876 (Forsberg) describes a wall construction having a geogrid connected to the blocks forming the wall in which apertures in the geogrid are hooked over pins extending from the blocks. The pins also serve to connect and vertically align adjacent blocks. Thus, in such a system, the geogrid is mechanically connected to the wall face. Although blocks having rear flanges may be used to build soil-reinforced walls, such systems suffer from several disadvantages. Previously referenced U.S. Pat. No. 5,294,216 (Sievert) describes a wall structure in which a geogrid is used with a rear flanged retaining wall block. In this system, the geogrid layer is passed below the flange. As a result, the geogrid is distorted out of a single plane as it passes under the flange, between the flange and the back face of the block in the course below, and then between the layers of block.

The use of a pin connection to the geogrid creates a stronger structure than does the rear flange-friction connection described above. First, for the geogrid to function properly, it must positioned between two courses of blocks and then placed under tension. The geogrid is tensioned by pulling it rearwardly and staking it down. Backfill is then placed over the geogrid. Because the geogrid connection described in the Sievert patent relies solely on friction and the weight of the block on the upper course, putting the geogrids into sufficient tension is difficult to accomplish because the geogrids tend to slip through the frictional connection. Second, the connection strength of the geogrid to the wall face is, in part, a function of the extent to which the geogrid extends between the block layers. If the geogrid is not placed sufficiently close to the front face of the wall, the frictional connection is severely compromised. This problem is compounded by the tendency of the geogrids to slip back during tensioning. Third, when placed under load, the geogrids abrade against the rough texture of the concrete flange, compromising the strength of the geogrid. Finally, when placed under load through earth pressures after construction or through tensioning during construction, the geogrids place an upward pressure on the blocks where they press against the flange. This results in a tendency to rotate the back of the block upward, thereby placing the wall out of batter and compromising the wall structure.

A basic deficiency of the rear flanged retaining wall blocks of the prior art is that they do not provide the structural soundness of a pin or other mechanical connection to the geogrid used in reinforced walls. Thus, a need exists for a system employing flanged retaining wall units that can combine the advantages of a rear-flanged unit, (i.e. simplicity and ease of construction for smaller walls), with the structural advantages of a pinned retaining wall unit in situations requiring the use of a geogrid. This need is significant because many retaining walls are constructed in height ranges that require the use of geogrid layers.

Additionally, many walls may be constructed to have a variable height along their length, and as such, geogrid reinforcement may be required only along certain portions of the wall, rather than along its entire length. Thus, it would be highly desirable to have a retaining wall that can be built using a rear flanged block in some wall sections and a pin connection between courses only in portions of the wall requiring geogrid. Such a unit would also be desirable from a production and distribution view point, because the same block design could be used in multiple wall applications, thus reducing the need to produce specialty units, as well as the need to maintain separate inventories of pinned and rear flanged products.

In view of the above, a need exists for a retaining wall block that may be constructed using a rear flange connection for walls not requiring geogrid reinforcement, but which can also be constructed using pins, instead of the flange, to provide an effective connection to geogrids for walls or wall sections where soil reinforcement is required for structural soundness.

SUMMARY OF THE INVENTION

The present invention provides an improved wall block that has a removable flange positioned at the rear of the block and pin apertures incorporated into the block to accommodate a pinned connection to a geogrid or fabric. Walls formed from such blocks can be constructed using the flange for alignment and interlocking where the use of a geogrid is not required. In wall sections in which the use of geogrid layers is desired, however, the flange can be removed, and the blocks can be aligned by pins that are placed in the pin apertures. The pin apertures typically, although not necessarily, have a generally circular cross section, and are positioned to be tangential to the front surface of the flange. Such positioning allows the pins to align the blocks with the same setback as would be produced by the flange. The use of pins in connection with a removable flange also allows a mechanical connection of the blocks to geogrids without the disadvantages of the rear flange friction connection described above.

More particularly, the present invention relates to a retaining wall block having a front surface spaced apart from a rear surface, an upper surface spaced apart from a substantially parallel lower surface to define a block thickness, first and second side wall surfaces adjoining the upper and lower surfaces, and a removable flange positioned adjacent to the rear surface and extending downward from the lower surface. The flange has a rear surface that is coplanar with the rear surface of the block, a bottom flange surface, and a front flange surface which typically, although not necessarily, defines a plane that is substantially parallel to the rear surfaces of the flange and the block. Alternatively, the front flange surface may be configured at an angle other than perpendicular relative to the lower surface of the block. The block is further provided with a plurality of pin apertures that are aligned along the bottom surface of the block. The apertures are oriented such that each is located in the flange tangential to the front surface of the flange. The apertures extend past the height of the flange into the body of the block. The size of the apertures is such that when pins are placed into the apertures, a secure friction fit is established to thereby prevent the pins from falling out of the block. The invention also relates to retaining walls constructed of the blocks described above.

BRIEF DESCRIPTION OF THE DRAWINGS

FIGS. 19*a–d* are perspective views of various front face designs that may be used with the blocks of the present invention.

FIGS. 20*a–d* are perspective views of various pin designs that may be used with the blocks of the present invention.

DETAILED DESCRIPTION OF THE INVENTION

Figure 1:
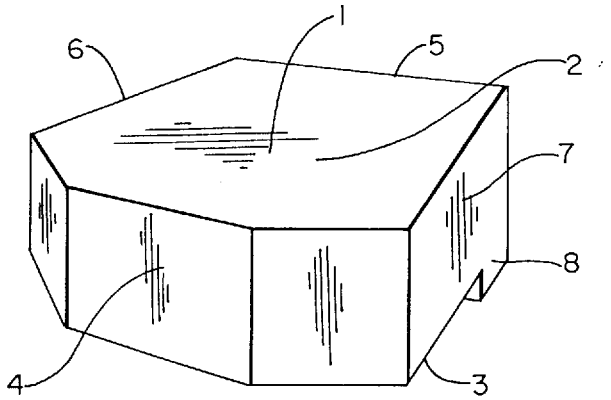
FIG. 1 is a perspective view of one preferred embodiment of the retaining wall block in accordance with the invention.
Figure 2:
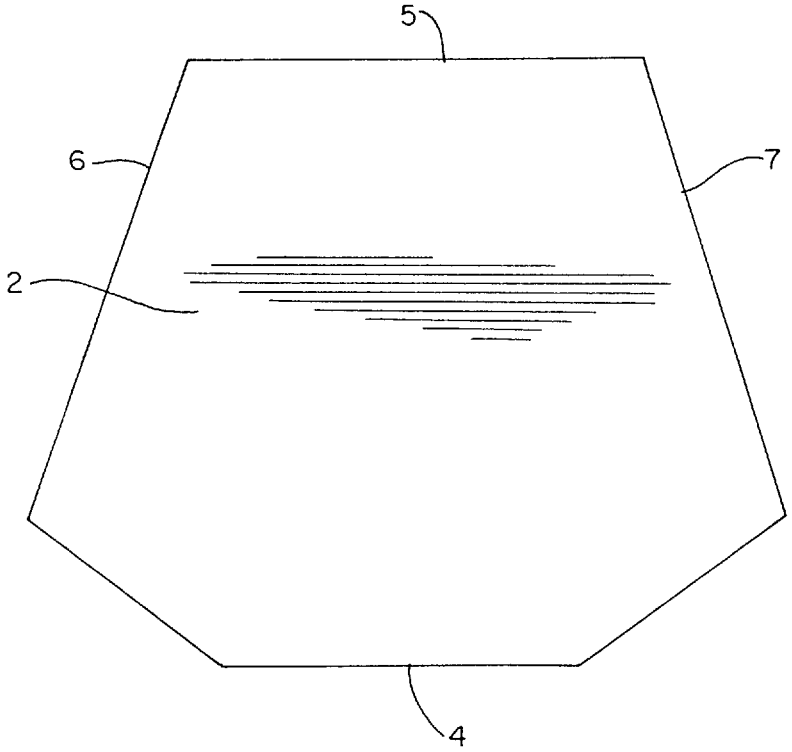
FIG. 2 is a top plan view of the retaining wall block shown in FIG. 1.
Figure 3:
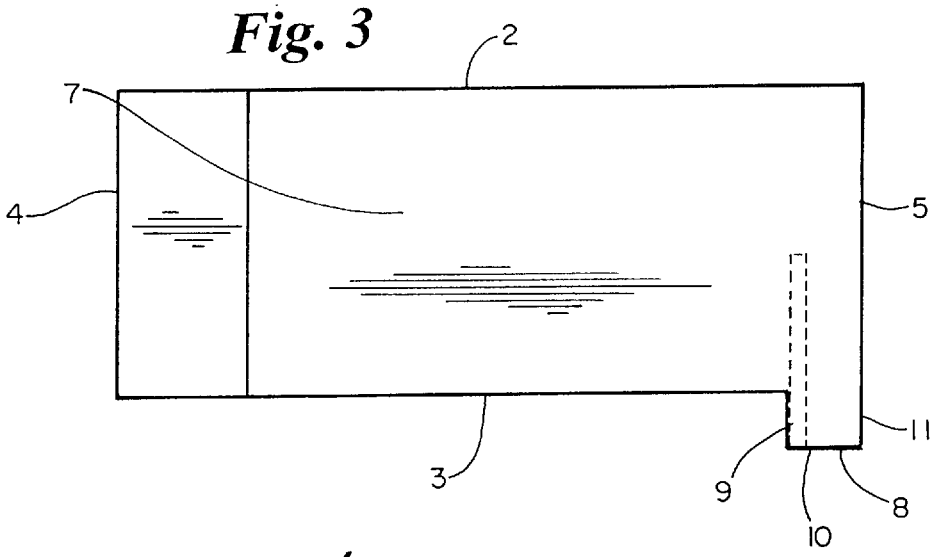
FIG. 3 is a side elevational view of the retaining wall block shown in FIG. 1.
Figure 4:
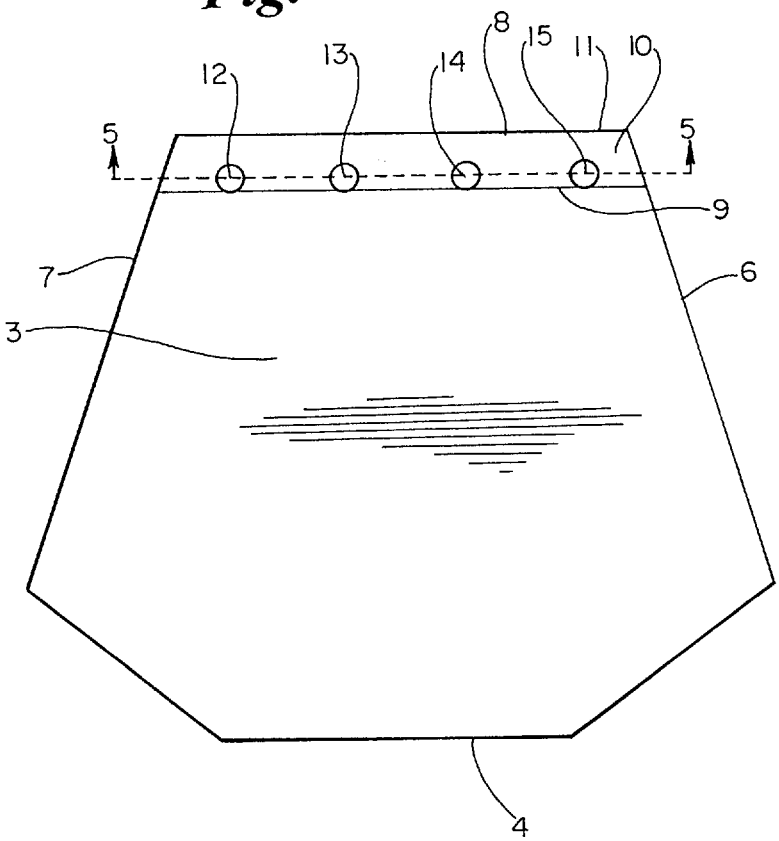
FIG. 4 is a bottom view of the retaining wall block shown in FIG. 1.
Figure 5:
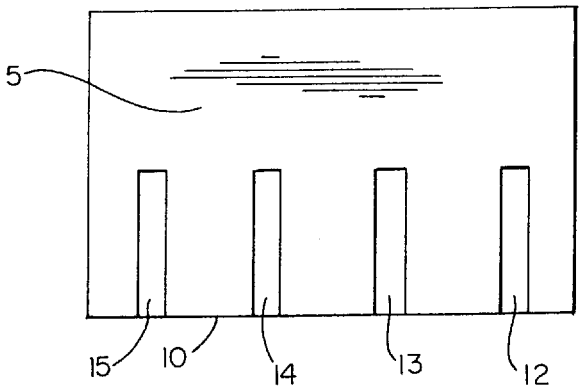
FIG. 5 is a section view drawn along line 5—5 from FIG. 4.

Referring to FIGS. 1–6, there is shown a retaining wall block 1 of the present invention. Block 1 is made of a rugged, weather resistant material, preferably pre-cast concrete. Other suitable materials are plastic, reinforced fibers, wood, metal and stone. As shown in FIG. 1, block 1 includes an upper surface 2 and a lower surface 3, spaced apart from and substantially parallel to each other by a dimension that defines the height or thickness of the block 1. The block further includes a front surface 4 and a rear surface 5 each being spaced from and substantially parallel to each other by a dimension that comprises the depth of block 1. Generally opposed first 6 and second 7 sidewalls, each being spaced from the other by a dimension defining the width of the block 1 are also present. The front surface 4, the rear surface 5 and each sidewall 6, 7 extends between the upper 2 and lower 3 surfaces.

Figure 19A:
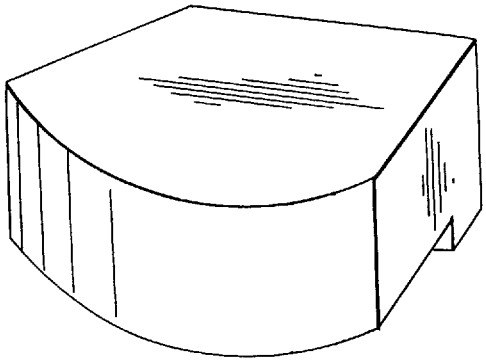
Figure 19B:
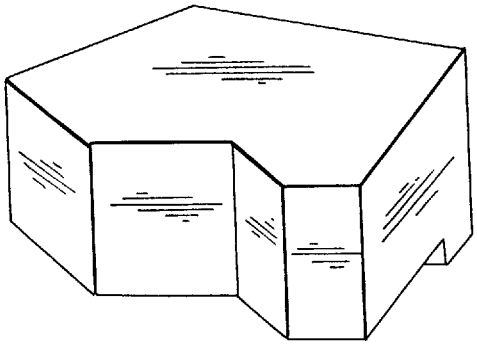

The front surface 4 of block 1 may have various aesthetically pleasing designs such as are shown in FIG. 1 and in FIGS. 19*a*–19*d*. For example, FIG. 1 depicts a block having a three plane front face, FIG. 19*a* depicts a block having a convex curved front face, FIG. 19*b* depicts a block having a multifaceted front face, FIG. 19*c* depicts a block having a planar front face, and FIG. 19*d* depicts a block having a face which includes a plurality of vertically spaced ribs. These and other aesthetic finishes may be used with the blocks of the present invention to provide various finished appearances for walls constructed form such blocks. Further examples of a variety of face finishes may be found in U.S. Design Pat. No. Des. 296,007 (Forsberg), the teachings of which are incorporated herein by reference. It should be understood, however, that the scope of the present invention is not intended to be limited to the particular face configuration selected.

The sidewalls 6 and 7 may be configured such that sidewall 6 is substantially parallel to sidewall 7. Alternatively, and preferably, sidewall 6 and 7 may converge toward each other as they approach rear surface 5. In that embodiment, the width of the block lessens as the sidewalls 6, 7 approach the rear surface 5. This block configuration is preferred because it allows the construction of serpentine walls, shown in FIGS. 13 and 14, more readily than would blocks having parallel sidewalls.

Block 1 includes a removable flange 8 extending from the rear surface 5 downward past the lower surface 3 of the block. The flange has a front surface 9, a bottom surface 10 and a back surface 11 that extends continuously from the rear surface 5 of the block. A plurality of pin apertures 12, 13, 14, 15 are provided in the flange 8, and extend perpendicular to the lower surface 3 of the block. The apertures 12, 13, 14, 15 are generally, although not necessarily, circular in cross section, and are positioned immediately adjacent to the front surface 9 of the flange 8. Positioned in this manner, the apertures are defined herein as being substantially "tangential" or "tangentially adjacent" to the front surface 9 of the flange.

The placement of the apertures in the manner described above is one important element of the block because such placement allows the block to maintain a substantially constant setback whether the flange or the pins are used to connect adjacent courses of blocks. Thus, the apertures are placed so that when the flange 8 is removed, and a pin or pins 16 are inserted into one or more of apertures 12–15, the portion of the pin 16 closest to the front surface 4 of the block will occupy a plane that had previously been defined by the front surface 9 of the flange 8. As such, the pin is caused to tangentially intercept a plane perpendicular to bottom surface 3 and located where the front surface 9 of flange 8 intercepted the plane of the bottom surface 3.

Flange 8 may have various dimensions, depending on the desired setback for walls constructed of the blocks. In a preferred embodiment of the present invention, flange 8 extends approximately one inch past the bottom surface 3 and the flange is approximately ¾" to one inch deep.

Pin apertures 12–15 extend beyond the flange and into the body of the block such that when the flange 8 is removed, apertures 12–15 extend about ⅓ to about ⅔ into the depth of the body of the block. In one preferred embodiment, apertures 12–15 extend about 2.5" into the block as measured from the bottom surface 3. Apertures 12–15 may be of various cross sections and diameters, however, a circular aperture having a diameter of about ⅜" is preferred. The diameter of pin 16 is approximately the same as that of the apertures so that the pins 16 may be seated firmly via a friction fit and do not fall out when the block is placed into service. The pin apertures 12–15 may be tapered such that they become narrower in diameter as they extend into the block to further encourage a tight fit between each pin and pin aperture.

As shown in FIGS. 20*a–d,* the pins 16 may have various configurations. Pins 16 may be hollow (FIG. 20*a*) or solid (FIG. 20*b*), and their exterior may be smooth, corrugated (FIGS. 20*c,* 20*d*), or otherwise configured to encourage a tight fit in the pin apertures. The pins 16 may be fabricated from various materials, including plastic extrusions or moldings. The dimensions of pin 16 may vary, but will correspond to the dimensions of the pin apertures such that a pin 16 may be inserted into a pin aperture and remain in position through friction or interlock. Preferred pins 16 are approximately ⅜" in diameter and approximately 3.5" long.

Figure 6:
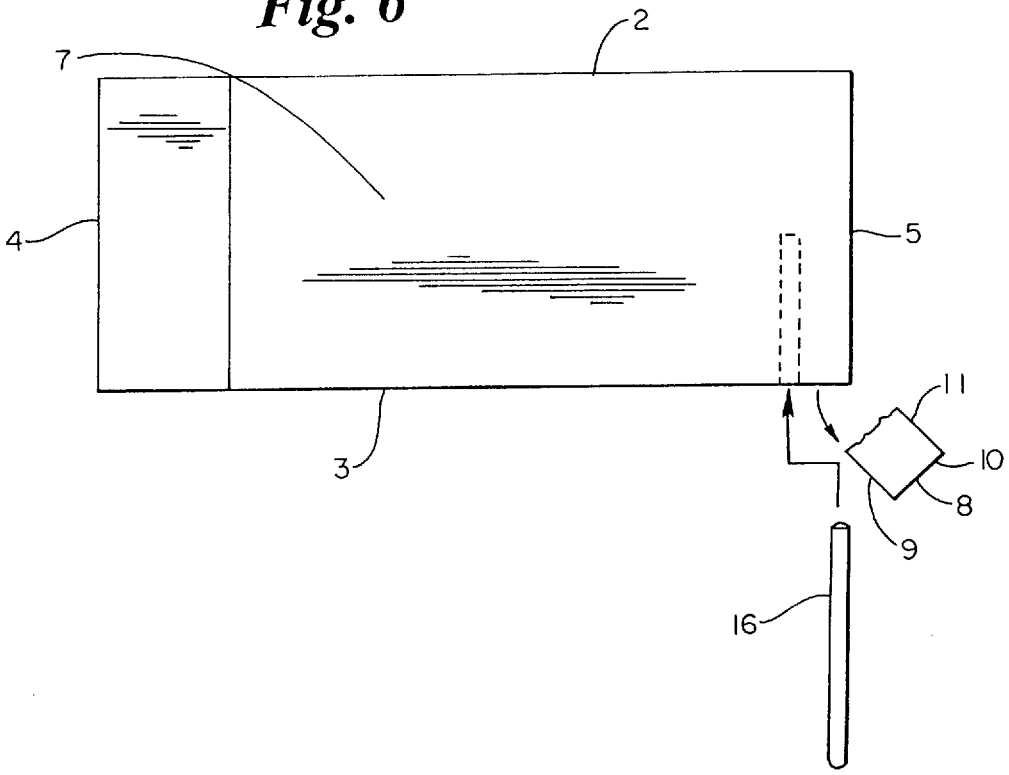
FIG. 6 is a side elevational view of the retaining wall block of FIG. 1 showing removal of the removable flange and a connection pin.
Figure 7:
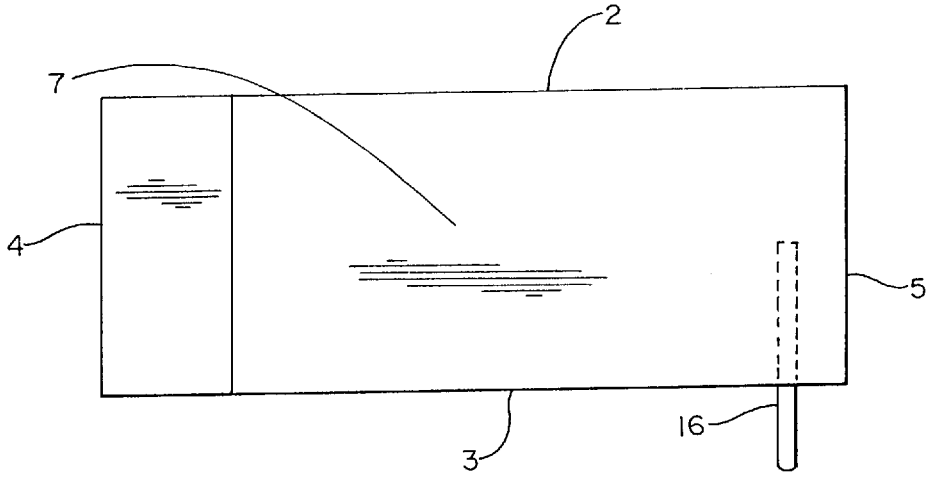
FIG. 7 is a side elevational view of the block of FIG. 6 showing the pin placed in a pin aperture.
Figure 8:
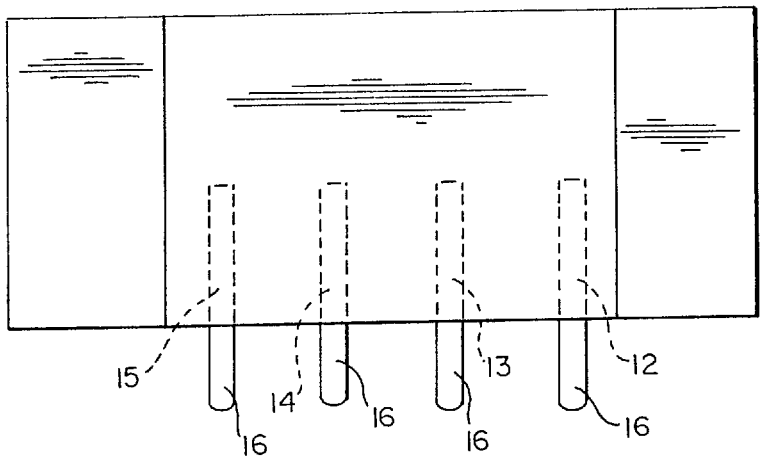
FIG. 8 is a rear elevation of the block of FIG. 6 with pins positioned in each of the pin apertures.
Figure 12:
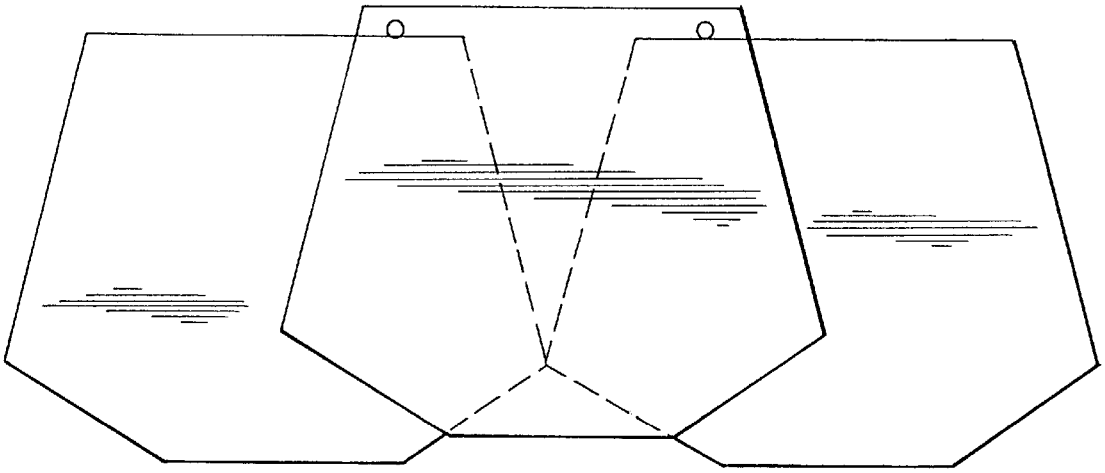
FIG. 12 is a top view of a straight wall section using the blocks of FIG. 6.
Figure 13:
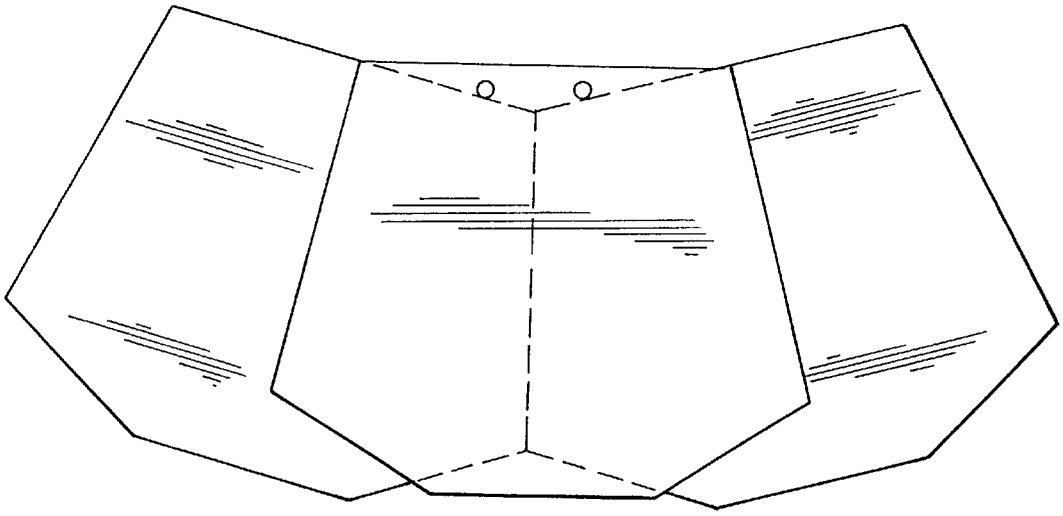
FIG. 13 is a top view of a convex wall section using the blocks of FIG. 6.
Figure 14:
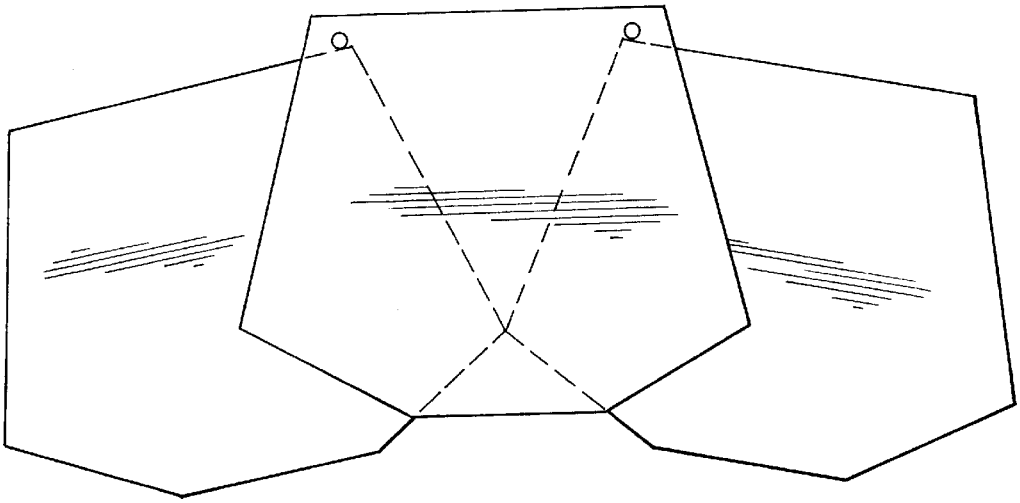
FIG. 14 is a top view of a concave wall section using the blocks of FIG. 6.
Figure 15:
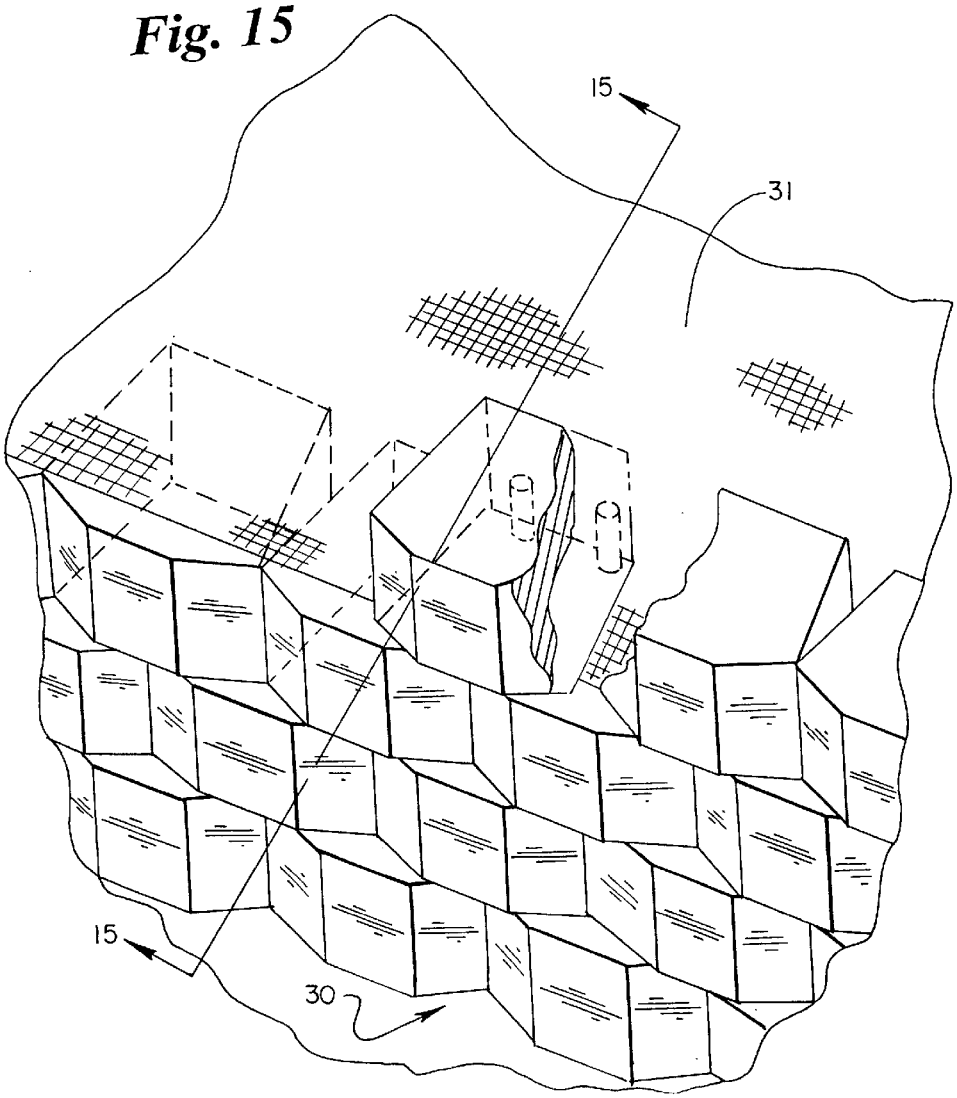
FIG. 15 is a partially cut away perspective view of a wall showing the use of a soil reinforcing matrix.
Figure 16:
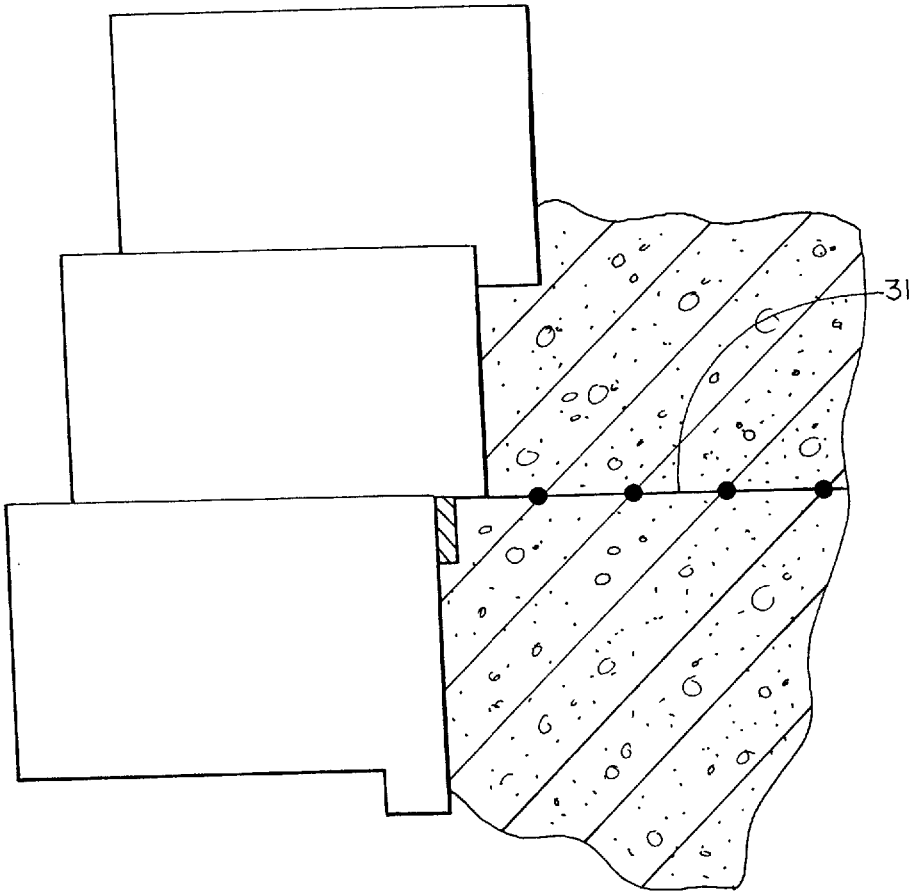
FIG. 16 is a cut away view of the wall of FIG. 15 drawn along the line 15—15.
Figure 17:
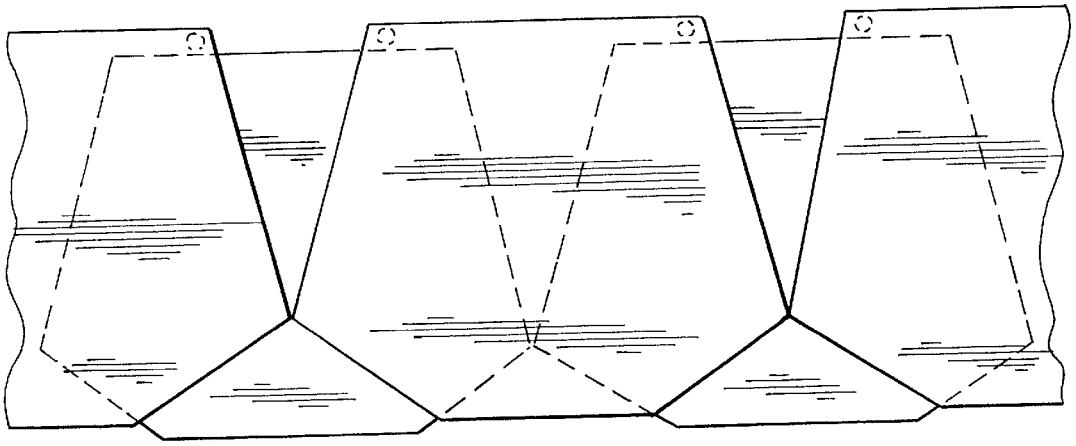
FIG. 17 is a top view of the wall of FIG. 15.
Figure 18:
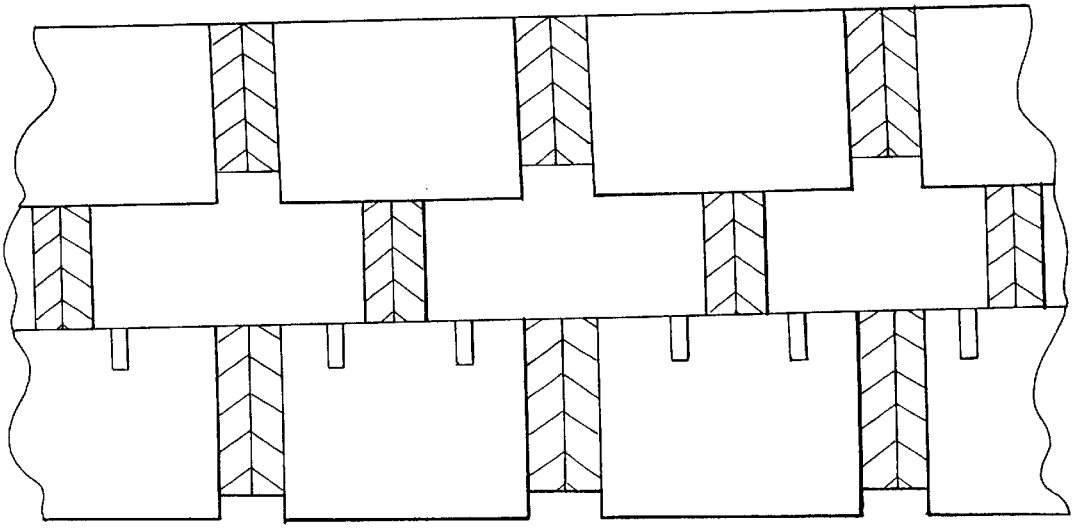
FIG. 18 is a rear view of the wall of FIG. 15.

As shown in FIG. 6, the block 1 may be converted from use as a rear flanged retaining wall block to a pinned retaining wall block by removing flange 8. This may be accomplished in the field by striking flange 8, such as with a hammer. After the flange 8 has been removed, pins 16 are placed preferably in at least two of the pin apertures 12–15. Views of the blocks of the present invention having pins 16 positioned in each of the pin apertures 12–15 are shown in FIGS. 7 and 8. It is noted, however, that each of the pin apertures 12–15 need not be provided with a pin 16. Rather, the selection of which apertures are used will depend on whether the portion of the wall being constructed is to be straight or curved. As shown in FIGS. 12–14, a wall having a straight or a convex front surface will employ the outside pin apertures 12, 15 to maintain proper setback for the wall. In contrast, when a concave wall is to be constructed, as in FIG. 14, the inside pin apertures 13, 14 are preferred to maintain appropriate alignment.

Figure 9:
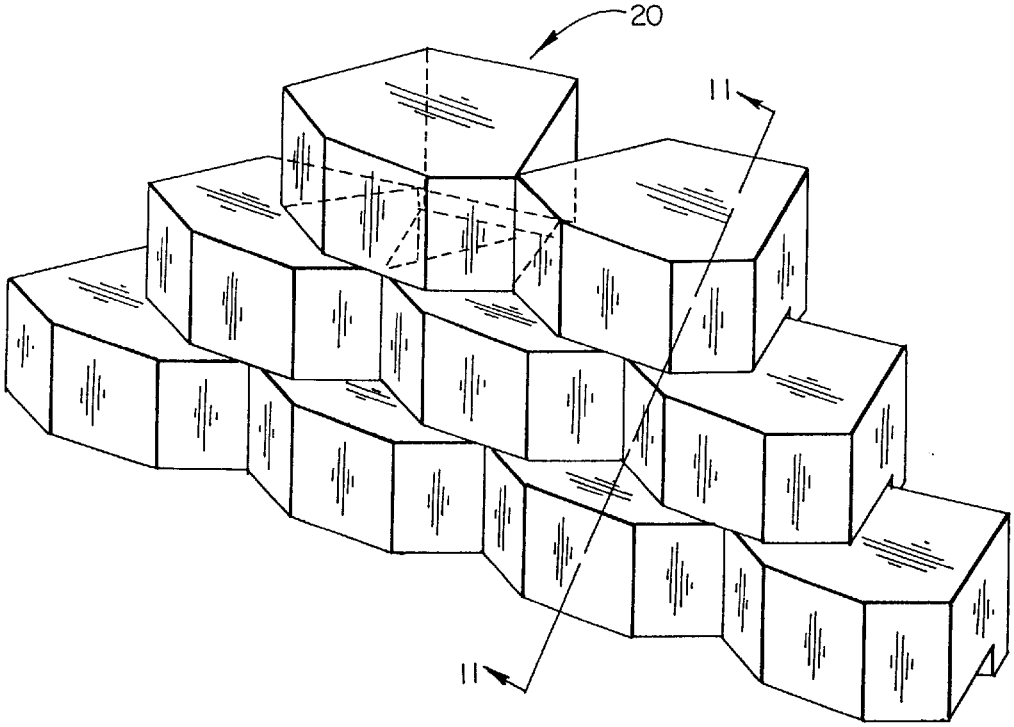
FIG. 9 is a partially cut away perspective view of a wall constructed with the blocks of FIG. 1 using flanges for alignment.
Figure 10:
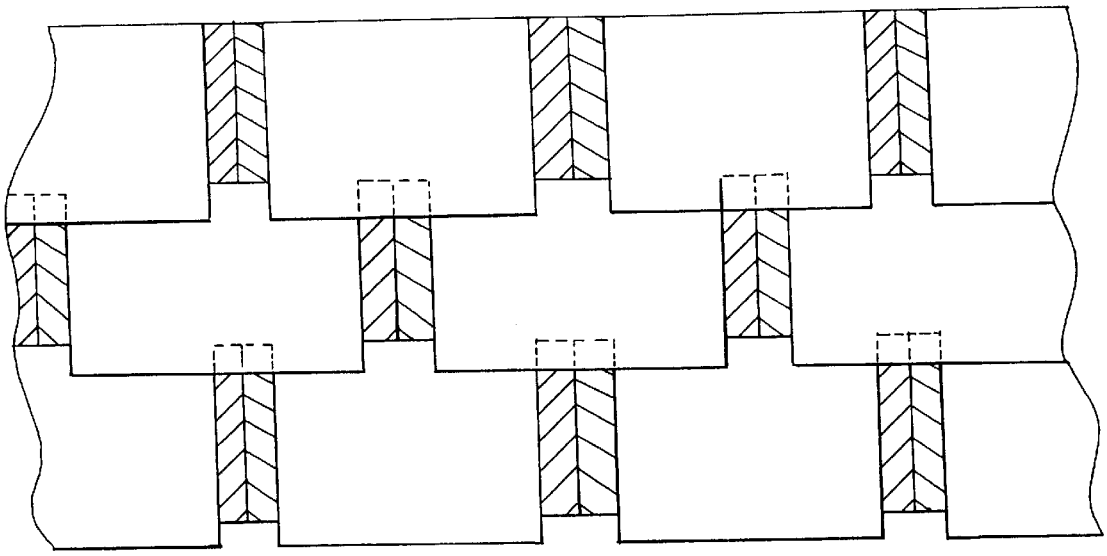
FIG. 10 is a rear view of the wall of FIG. 9.
Figure 11:
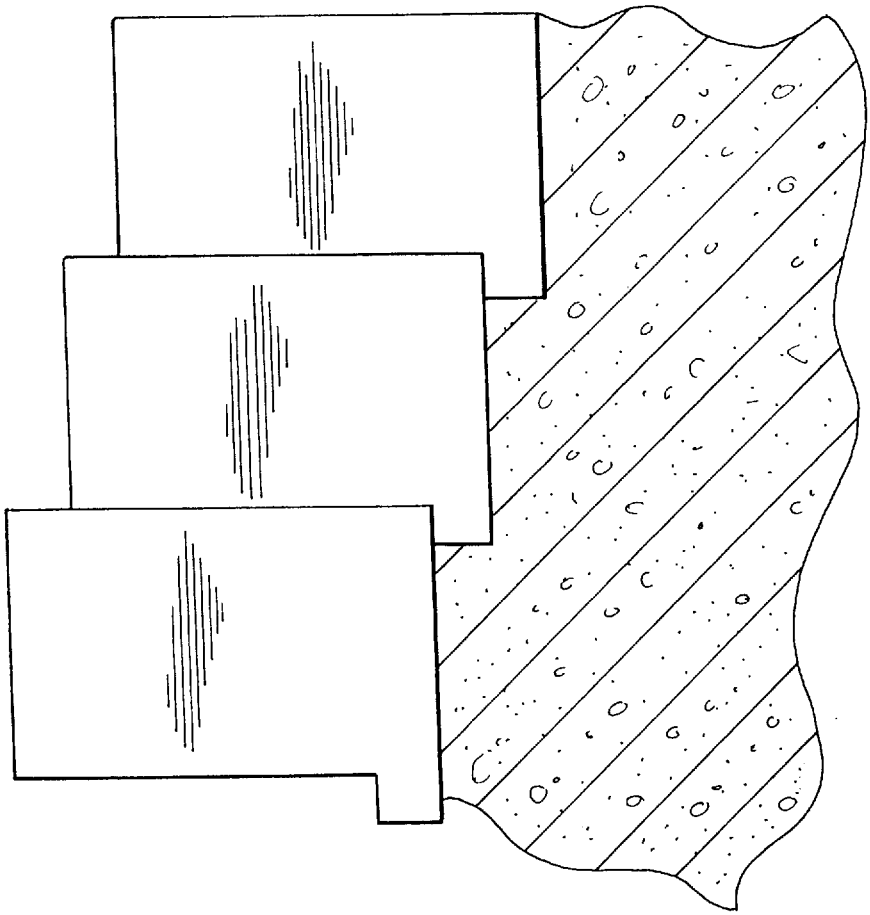
FIG. 11 is a cut away view of the wall of FIG. 9 drawn along the line 11—11.

FIGS. 9–11 depict a wall 20 constructed of the blocks of the present invention. The wall depicted is constructed using techniques well known in the field. These include the installation of a base material, preferably composed of material that is suitable for compaction, the leveling of the base material, and the installation and leveling of the first course of blocks onto the base material. Succeeding courses of blocks 1 are stacked in a running bond pattern and back fill is placed and compacted behind the blocks until the wall is of the desired height. For wall installations not requiring soil reinforcement, each block 1 is used without removing flange 8, however, to fabricate curves, portions of the flange 8 may be removed from selected blocks to maintain proper setback.

FIGS. 15–18 depict a wall 30 constructed of blocks 1 which employ pins to connect the wall to a geogrid soil reinforcement system. Typically, walls greater than about three feet in height require soil reinforcement, however, this may vary depending on block dimensions, soil characteristics, and loading conditions behind the wall. Wall 30 is constructed using similar techniques to those described above. In addition, wall 30 incorporates a geogrid 31 which is placed according to engineering design plans.

The wall is constructed as described above using a rear flange connection until the wall reaches an elevation where a geogrid layer is to be employed. The blocks in the courses below the geogrid layer are placed and the backfill is placed and compacted up to the desired elevation. The geogrid 31 is laid onto the blocks and over the backfill to the specified length. The next course of blocks are prepared for placement by removing the flange 8 and placing the pins 16 into at least two of the pin apertures 12–15. The blocks 1 are then placed over the geogrid such that pins 16 extend through apertures in the geogrid 31 and engage the back surface of the blocks in the course below. The geogrid 31 is then tensioned by pulling it in a rearward direction, generally perpendicular to the face of the wall. Once tensioned, the geogrid is secured in a tensioned state by placing a stake into the backfill through an aperture in the geogrid. The wall is then backfilled and compacted, and additional blocks are placed until the wall reaches the desired height. Depending upon the final height of the wall, it may be necessary or desirable to place additional geogrid layers at selected heights of the wall.

Equivalents

From the foregoing detailed description of specific embodiments of the invention, it should be apparent that a unique retaining wall block and retaining wall made therefrom have been described. Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A retaining wall block comprising:

a) a front surface spaced apart from a rear surface;

b) an upper surface spaced apart from a substantially parallel lower surface, thereby defining a block thickness;

c) first and second side wall surfaces adjoining the upper and lower surfaces, the side wall surfaces extending between the front surface and the rear surface;

d) a plurality of apertures, each extending into the block thickness toward the upper surface and adapted to receive a pin; and, e) a removable flange having a rear surface coplanar with the rear surface of the block and extending downward from the lower surface of the block.

2. A retaining wall block as in claim 1, wherein the apertures extend through the flange and into the block.

3. A retaining wall block as in claim 2, wherein the apertures extend between about ⅓ to about ⅔ into the block thickness.

4. A retaining wall block as in claim 1, wherein the flange has a front flange surface that defines a plane that is substantially parallel to the rear surfaces of the flange and the block.

5. A retaining wall block as in claim 4, wherein the apertures are positioned adjacent to the front flange surface.

6. A retaining wall block as in claim 4, wherein the apertures are positioned substantially tangentially adjacent to the front flange surface.

7. A retaining wall comprising at least a first lower course and a second upper course, each of the courses comprising one or more retaining wall blocks, each of said blocks comprising:

a) a front surface spaced apart from a rear surface;

b) an upper surface spaced apart from a substantially parallel lower surface, thereby defining a block thickness;

c) first and second side wall surfaces adjoining the upper and lower surfaces, the side wall surfaces extending between the front surface and the rear surface;

d) a plurality of apertures, each extending into the block thickness toward the upper surface and adapted to receive a pin; and, e) a removable flange having a rear surface coplanar with the rear surface of the block and extending downward from the lower surface of the block.

8. A retaining wall as in claim 7, wherein the apertures extend through the flange and into the block.

9. A retaining wall as in claim 8, wherein the apertures extend between about ⅓ to about ⅔ into the block thickness.

10. A retaining wall claim 7, wherein the flange has a front flange surface that defines a plane that is substantially parallel to the rear surfaces of the flange and the block.

11. A retaining wall as in claim 10, wherein the apertures are positioned adjacent to the front flange surface.

12. A retaining wall as in claim 10, wherein the apertures are positioned tangentially adjacent to the front flange surface.

13. A retaining wall as in claim 8, wherein at least one pin is positioned in at least one aperture in at least one block in the second course.

14. A retaining wall as in claim 7, which further includes at least one soil reinforcement matrix.

15. A retaining wall as in claim 14, wherein the matrix is interposed between at least a portion of a block in the first course and at least a portion of a block in the second course.

16. A retaining wall as in claim 15, wherein at least a portion of the lower surface of the block in the second course is positioned on at least a portion of the upper surface of the block in the lower course, the flange of the block in the second course has been removed, and pins passing through the soil reinforcement matrix have been used to maintain the matrix in position.

17. A retaining wall as in claim 14, which comprises at least one additional course, the additional course not having a soil reinforcement matrix interposed between it and the courses to which it is adjacent.

18. A retaining wall block comprising:

a) a front surface spaced apart from a rear surface;

b) an upper surface spaced apart from a substantially parallel lower surface, thereby defining a block thickness;

c) first and second side wall surfaces adjoining the upper and lower surfaces, the side wall surfaces extending between the front surface and the rear surface;

d) a plurality of apertures, each extending into the block thickness toward the upper surface and adapted to receive a pin; and e) a removable flange having a rear surface, the removable flange positioned adjacent to the rear surface of the block and extending downward from the lower surface, wherein a portion of the rear surface of the block forms the rear surface of the flange.

19. A retaining wall block as in claim 18, wherein the apertures extend through the flange and into the block.

20. A retaining wall block comprising:

a) a front surface spaced apart from a rear surface;

b) an upper surface spaced apart from a substantially parallel lower surface, thereby defining a block thickness;

c) first and second side wall surfaces adjoining the upper and lower surfaces, the side wall surfaces extending between the front surface and the rear surface;

d) a plurality of apertures, each extending into the block thickness toward the upper surface and adapted to receive a pin; and, e) a removable flange positioned adjacent to the rear surface, the flange configured such that when the flange is removed from the block, the bottom surface of the block lies substantially within a single plane.

21. A retaining wall block as in claim 20 wherein the apertures extend through the flange and into the block.

22. A retaining wall comprising at least a first lower course and a second upper course, each of the courses comprising one or more retaining wall blocks, each of said blocks comprising:

a) a front surface spaced apart from a rear surface;

b) an upper surface spaced apart from a substantially parallel lower surface, thereby defining a block thickness;

c) first and second side wall surfaces adjoining the upper and lower surfaces, the side wall surfaces extending between the front surface and the rear surface;

d) a plurality of apertures, each extending into the block thickness toward the upper surface and adapted to receive a pin; and e) a removable flange having a rear surface, the removable flange positioned adjacent to the rear surface of the block and extending downward from the lower surface, wherein a portion of the rear surface of the block forms the rear surface of the flange.

23. A retaining wall as in claim 22, wherein the apertures extend through the flange and into the block.

24. A retaining wall comprising at least a first lower course and a second upper course, each of the courses comprising one or more retaining wall blocks, each of said blocks comprising:

a) a front surface spaced apart from a rear surface;

b) an upper surface spaced apart from a substantially parallel lower surface, thereby defining a block thickness;

c) first and second side wall surfaces adjoining the upper and lower surfaces, the side wall surfaces extending between the front surface and the rear surface;

d) a plurality of apertures, each extending into the block thickness toward the upper surface and adapted to receive a pin; and, e) a removable flange positioned adjacent to the rear surface, the flange configured such that when the flange is removed from the block, the bottom surface of the block lies substantially within a single plane.

25. A retaining wall as in claim 24, wherein the apertures extend through the flange and into the block.

* * * * *